US010808348B2

(12) United States Patent
Zhao et al.

(10) Patent No.: US 10,808,348 B2
(45) Date of Patent: Oct. 20, 2020

(54) HYDRAULIC LIFTING SUPPORT, WASHING MACHINE WITH THE HYDRAULIC LIFTING SUPPORT, AND CONTROLLING METHOD THEREOF

(71) Applicants: QINGDAO HAIER WASHING MACHINE CO., LTD., Shandong (CN); QINGDAO HAIER SMART TECHNOLOGY R&D CO., LTD., Shandong (CN)

(72) Inventors: Zhiqiang Zhao, Shandong (CN); Sheng Xu, Shandong (CN)

(73) Assignees: QINGDAO HAIER WASHING MACHINE CO., LTD., Qingdao, Shandong (CN); QINGDAO HAIER SMART TECHNOLOGY R&D CO., LTD., Qingdao, Shandong (CN)

( * ) Notice: Subject to any disclaimer, the term of this patent is extended or adjusted under 35 U.S.C. 154(b) by 301 days.

(21) Appl. No.: 15/778,698

(22) PCT Filed: Jun. 29, 2017

(86) PCT No.: PCT/CN2017/090859
§ 371 (c)(1),
(2) Date: May 24, 2018

(87) PCT Pub. No.: WO2018/176667
PCT Pub. Date: Oct. 4, 2018

(65) Prior Publication Data

US 2019/0203399 A1 Jul. 4, 2019

(30) Foreign Application Priority Data

Mar. 30, 2017 (CN) ..... 2017 1 0202697

(51) Int. Cl.
*D06F 37/22* (2006.01)
*D06F 37/20* (2006.01)
(Continued)

(52) U.S. Cl.
CPC ..... *D06F 37/22* (2013.01); *B66F 3/247* (2013.01); *B66F 11/00* (2013.01); *D06F 37/203* (2013.01);
(Continued)

(58) Field of Classification Search
CPC ..... D06F 37/22
See application file for complete search history.

(56) References Cited

U.S. PATENT DOCUMENTS 3,899,187 A 8/1975 Millett
8,302,743 B2 11/2012 Pike et al.
(Continued)

FOREIGN PATENT DOCUMENTS

CN 2301466 Y 12/1998
CN 101023239 A 8/2007
(Continued)

*Primary Examiner* — Jason Y Ko
(74) *Attorney, Agent, or Firm* — Buchanan Ingersoll & Rooney PC

(57) ABSTRACT

The present disclosure provides a hydraulic lifting support, washing machine and controlling method. The hydraulic lifting support comprises a hydraulic support, a communicating device and a liquid storage device. The hydraulic support comprises a fix section installed at a bottom of a household appliance, a movable adjustment section sleeved with the fix section and axially movable relative to the fix section; an accommodation chamber is arranged between the fix section and the movable adjustment section; at least two hydraulic supports and a liquid storage device are communicated with each other by a communicating device; the hydraulic medium flows between the hydraulic supports
(Continued)

along with the pressure changing, and the hydraulic medium drives the movable adjustment section to move axially for leveling under pressure; the hydraulic medium is injected into/sucked from the hydraulic supports through the liquid storage device to control the lifting and lowering adjustment of the hydraulic supports.

16 Claims, 2 Drawing Sheets

(51) Int. Cl.

| | |
|---|---|
| ***B66F 11/00*** | (2006.01) |
| ***B66F 3/24*** | (2006.01) |
| ***D06F 39/00*** | (2020.01) |
| ***D06F 39/12*** | (2006.01) |
| *B08B 13/00* | (2006.01) |

(52) U.S. Cl.
CPC ..... *D06F 39/00* (2013.01); *D06F 39/12* (2013.01); *B08B 13/00* (2013.01); *B66F 2700/052* (2013.01); *D06F 2202/06* (2013.01); *D06F 2204/06* (2013.01)

(56) References Cited

U.S. PATENT DOCUMENTS

| | | | |
|---|---|---|---|
| 2007/0205342 | A1 | 9/2007 | Gabriel |
| 2015/0122967 | A1 | 5/2015 | Kim |
| 2016/0025261 | A1 | 1/2016 | Pike et al. |
| 2018/0187362 | A1 | 7/2018 | Zhao et al. |
| 2018/0195227 | A1 | 7/2018 | Zhao et al. |
| 2018/0202095 | A1 | 7/2018 | Zhao et al. |
| 2019/0174831 | A1 | 6/2019 | Qiu |

FOREIGN PATENT DOCUMENTS

| | | | |
|---|---|---|---|
| CN | 201151829 | Y | 11/2008 |
| CN | 101864891 | A | 10/2010 |
| CN | 102858204 | A | 1/2013 |
| CN | 104631042 | A | 5/2015 |
| CN | 105755750 | A | 7/2016 |
| CN | 105755757 | A | 7/2016 |
| CN | 105757408 | A | 7/2016 |
| CN | 105862317 | A | 8/2016 |
| CN | 105986393 | A | 10/2016 |
| CN | 106108121 | A | 11/2016 |
| CN | 205741632 | U | 11/2016 |
| CN | 106245262 | A | 12/2016 |
| FR | 1319554 | A | 3/1963 |
| GB | 946372 | A | 1/1964 |
| KR | 100787063 | B1 | 12/2007 |
| WO | 01/20172 | A2 | 3/2001 |

HYDRAULIC LIFTING SUPPORT, WASHING MACHINE WITH THE HYDRAULIC LIFTING SUPPORT, AND CONTROLLING METHOD THEREOF

TECHNICAL FIELD

The present disclosure relates to the technical field of support leveling of household appliances, and specifically relates to a hydraulic lifting support, a washing machine with the hydraulic lifting support and controlling method thereof.

BACKGROUND

A household appliance is generally provided with a leveling device at the bottom of its casing. During placement of the household appliance, the leveling device is adjusted to make the household appliance stably placed. After the household appliance is leveled, the leveling device can support the household appliance to keep the household appliance stable.

Taking a washing machine for example, the existing washing machine is usually provided with bolt supports mounted at the bottom of its casing or the whole machine. Each bolt support comprises a screw rod, a nut washer and a rubber pad. The nut washer can be screwed up and down around the screw rod, and the screw rod can also be screwed up and down in a screw hole in a base plate of the casing. Therefore, the height of the washing machine can be adjusted by screwing the screw rods of the bolt supports into different lengths of the crew holes in the base plate. Mostly, the height of the washing machine is increased if the supports of the washing machine rotate counterclockwise, and the height of the washing machine is reduced if the supports of the washing machine rotate clockwise. After the height adjustment of the bolt supports is completed, the nut washers for preventing loosening are tightened to keep the washing machine stable.

Although said bolt supports of the washing machine implement the leveling of the washing machine, a user still needs to carry out manual adjustment. If the washing machine has a relatively large self weight or a placement space for the washing machine is narrow, it is very inconvenient to operate for user. Additionally, vibration of the washing machine in a long-term working process also act on the leveling supports and causes support failure of the supports, resulting in unlevel placement of the washing machine.

For example, an existing 8 KG drum washing machine generally has a weight of about 80 KG; which is relatively heavy, so its height adjustment is very inconvenient for users. Even though the height adjustment is completed, it cannot be ensured that the washing machine is adjusted to an optimal state. When the washing machine works, especially accelerates from 0 r/min to about 1400 r/min for drying, large vibration will occur if the washing machine is placed unlevel or has a failure of support problem, which greatly influences use comfortableness of the user.

In addition, the vibration of the unlevel washing machine may cause loosening of support screws, which result in vertical movement of a support bracket, and such unstability may change the leveling state of the washing machine and cause stronger vibration. Due to such vicious circle, after the washing machine is used for a long term, the noise is larger and larger, the washing machine per se is also damaged to a certain extent, and the service life of the washing machine is shortened.

Therefore, the leveling of the existing washing machine has problems that manual adjustment is needed, time and labor are wasted, and precision is relatively low.

In addition, the drum washing machine has a problem of halfway adding clothes. As an outer tub of the drum washing machine is usually horizontally set, after entering washing water, sometimes the liquid level is higher than the seal of the door and window. Once the door is opened, the washing water will spew out. Therefore, in the prior art, after the washing machine begins to work, the user cannot open the door and window to add clothes in the halfway, but it brings a great deal of inconvenience to the consumers when they need to add clothes.

In view of the foregoing, the present disclosure is proposed.

SUMMARY

In order to solve the above-mentioned problems, the present disclosure provides a hydraulic lifting support, a washing machine with the hydraulic lifting support and controlling method thereof, and concretely, a technical solution adopted by the present disclosure is as follows:

A first disclosure object of the present disclosure is to provide a hydraulic lifting support for the support leveling of a household appliance comprising a hydraulic support, a communicating device and a liquid storage device, the hydraulic support comprises:

a fix section, installed at a bottom of the household appliance;

a movable adjustment section, sleeved with the fix section and axially movable relative to the fix section;

an accommodation chamber for containing a hydraulic medium is arranged between the fix section and the movable adjustment section;

at least two hydraulic supports and the liquid storage device are communicated with each other by the communicating device; the hydraulic medium flows between the hydraulic supports along with the pressure changing, and the hydraulic medium drives the movable adjustment section to move axially for leveling under pressure; the hydraulic medium is injected into/sucked from the hydraulic supports through the liquid storage device, controlling the lifting and lowering of the hydraulic supports.

Further, the communicating device comprises a hydraulic pipe and a communicating member. One end of the hydraulic pipe connects with the hydraulic supports or the liquid storage device, another end connects with a same communicating member; a liquid flow channels communicated with each other is arranged in the communicating member for communicating between the hydraulic supports, and between the hydraulic support and the liquid storage device.

Preferably, the communicating member is a three-way communicating member, and three connection ends of the three-way communicating member are respectively connected with two hydraulic supports and the liquid storage device through the hydraulic pipe.

Further, the liquid storage device comprises a liquid storage tank containing the hydraulic medium and a driving device for driving the hydraulic medium in the liquid storage tank to flow into the hydraulic support.

Further, the driving device comprises a motor and a piston mechanism. The piston mechanism is disposed in the liquid storage tank, and an output end of the motor is connected with the piston mechanism to drive the piston mechanism to slide inside the liquid storage tank. The motor is energized to drive the piston mechanism to compress the hydraulic medium in the liquid storage tank, and the hydraulic medium in the liquid storage tank is injected into the hydraulic support.

Further, the fix section comprises a hydraulic plate and a sheath connected with the hydraulic plate. A hollow chamber is arranged in the sheath and extends axially through the sheath. The movable adjustment section is a regulating element, and an inner chamber with one opening end is arranged inside the regulating element. One end of the sheath is sleeved inside the regulating element and is capable of moving axially relative to the regulating element. The hollow chamber and the inner chamber form the accommodation chamber together.

The hydraulic plate is internally provided with a hydraulic plate flow channel for allowing the hydraulic medium to flow, and the hydraulic plate flow channels of the hydraulic supports are connected by the communicating device for allowing the hydraulic medium to flow between the hydraulic supports.

A second disclosure object of the present disclosure is to provide a washing machine with the hydraulic lifting supports described above. The washing machine being a drum washing machine, comprising a shell and a door mounted on the shell and capable of being opened/closed. The shell comprises a front plate and a bottom plate. The front plate is provided with a door opening, and the door is mounted on the front plate to close/open the door opening. The hydraulic lifting support is installed on the bottom plate and is disposed in an edge where the bottom plate intersects with the front plate.

Further, it comprises a control device, the motor of the liquid storage device is electrically connected with the control device, and the control device controls the operation of the motor to enable the hydraulic medium to flow into the hydraulic support.

Further, two hydraulic supports are respectively installed on two corners of the bottom plate that near the front plate. The two hydraulic supports and the liquid storage device are communicated with each other by the communicating device. In addition, two bolt supports are respectively installed on the other two corners of the bottom plate.

A third disclosure object of the present disclosure is to provide a controlling method for a washing machine. If the washing machine detects that users need to open the door for adding clothes in the halfway and the water level is higher than the door opening controlling the liquid storage device to inject the hydraulic medium into the hydraulic support to raise a support height of the hydraulic support, so that a side with the door of the washing machine rises along with the lifting of the hydraulic support. If the water level is detected lower than the door opening, the door is allowed to open.

Further, if the washing machine detects that users finish adding clothes, the door is closed and the motor of the liquid storage device is controlled to be power off. The hydraulic medium in the hydraulic support is gradually returned to the liquid storage tank under the gravity of the washing machine. Thus, the hydraulic support implements automatic leveling during the flowing of the hydraulic medium.

The hydraulic lifting support of the present disclosure, based on the hydraulic principle, the movable adjustment section can automatically perform adaptive regulation because of the fluidity of the hydraulic medium due to different pressures resulting from unflatness. The hydraulic medium stops circulating until the leveling device achieves balance, and thus, automatic leveling is achieved.

The hydraulic lifting support of the present disclosure enables the control device of the washing machine to send a signal to the motor and provide power when the consumer needs to add the left laundry that needs to be washed halfway. After pressing a pause button or a specific halfway button, the motor starts and compresses the hydraulic medium in the liquid storage tank to flow into the hydraulic support. Thus, the continuous extension of the regulating element and the extension of the front hydraulic support are achieved. Next, the front of the washing machine is raised, and then washing water level is lower than the seal of the door and window. Even if a consumer opens the door, the washing water will not overflow.

The hydraulic lifting support of the present disclosure is especially suitable for a drum washing machine. The supporting height of the hydraulic supports is raised by the liquid storage device to lift the door opening, so that the water level is lower than the door opening to realize opening the door halfway and adding clothes.

| Reference signs: |
|---|
| 100-hydraulic support |
| 101-hydraulic plate |
| 103-sheath |
| 104-regulating element |
| 200-hydraulic pipe |
| 300-communicating member |
| 400-liquid storage tank |
| 500-motor |
| 600-power line |
| 700-signal line |
| 800-door |
| 900-detergent box |
| 901-bottom plate |
| 902-front plate |
| 903-side plate |
| 904-top plate |
| 1000-control device |
| 1100-outer tub |
| 1200-water level |
| 1300-bolt support |

DETAILED DESCRIPTION

A hydraulic lifting support, a washing machine with the hydraulic lifting support and controlling method thereof are described in detail as follows with reference to the accompanying drawings below:

Embodiment 1

Figure 1:
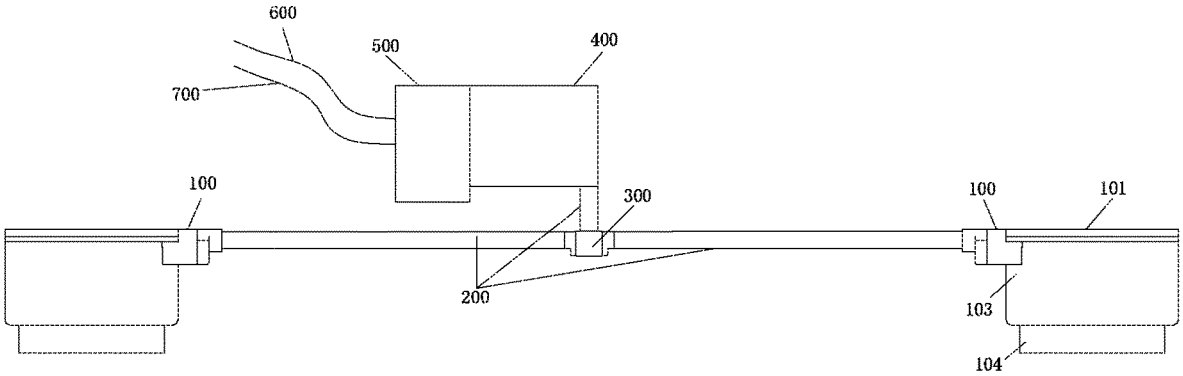
FIG. 1 is a front view of a hydraulic lifting support according to embodiment 1 of the present disclosure.
Figure 2:
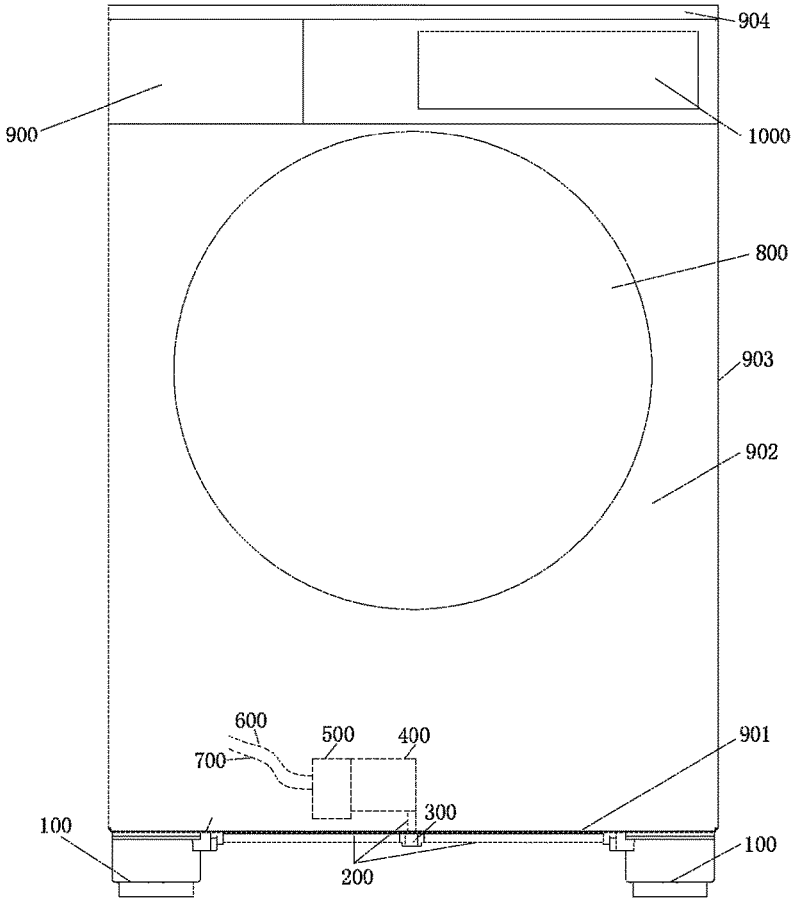
FIG. 2 is a front view of a washing machine according to embodiment 2 of the present disclosure.
Figure 3:
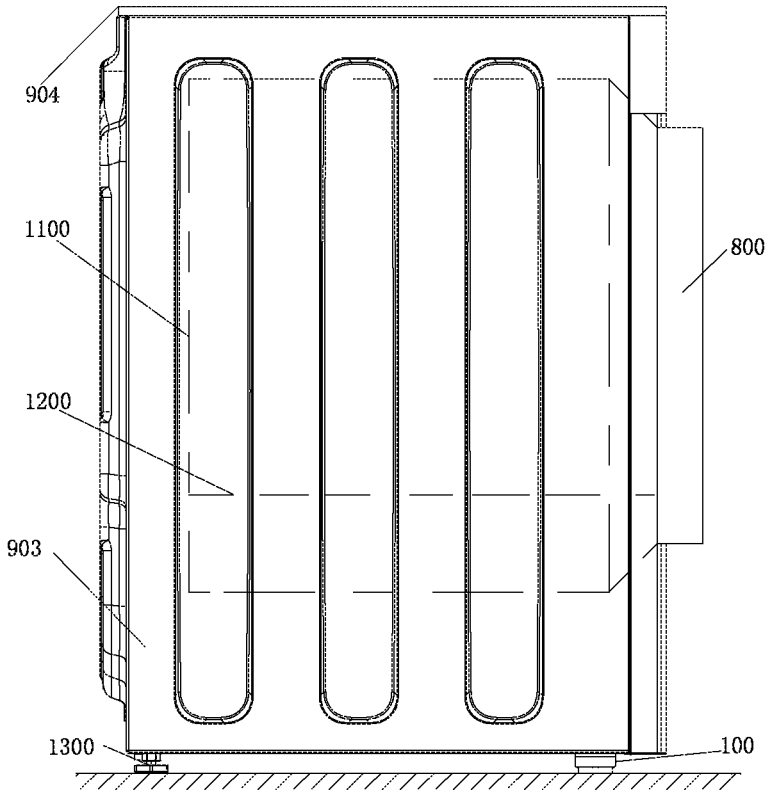
FIG. 3 is a side view of a washing machine according to embodiment 2 of the present disclosure (the motor of the liquid storage device is closed)
Figure 4:
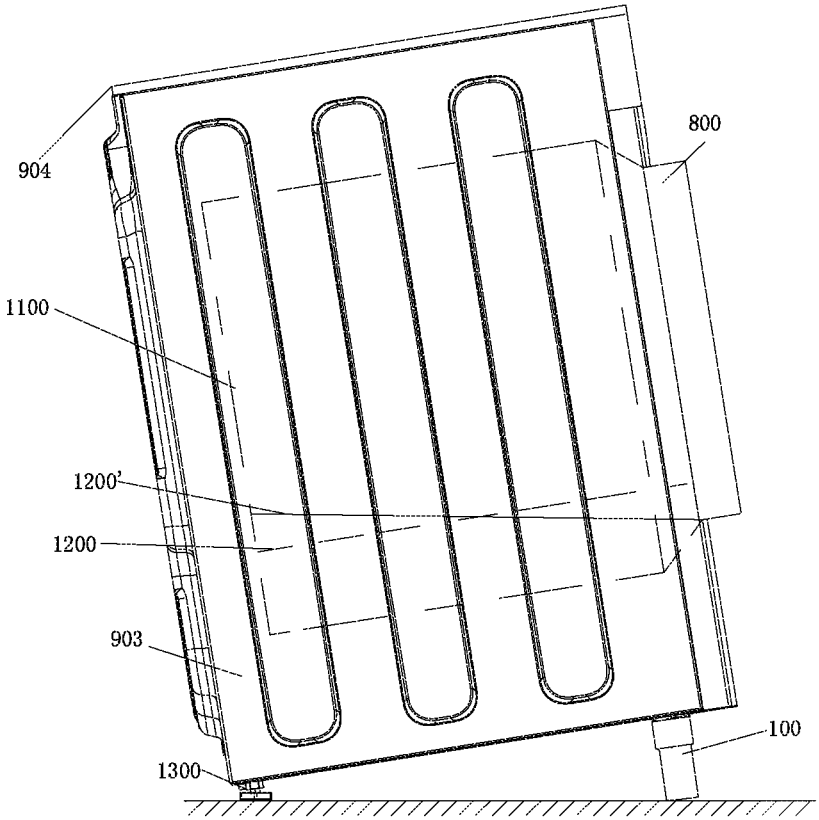
FIG. 4 is a side view of a washing machine according to embodiment 2 of the present disclosure (the motor of the liquid storage device is open)

As shown in FIG. 1, a hydraulic lifting support of the present embodiment for the support leveling of a household appliance comprises a hydraulic support 100, a communicating device and a liquid storage device, the hydraulic support 100 comprises:

a fix section, installed at a bottom of a household appliance;

a movable adjustment section, sleeved with the fix section and axially movable relative to the fix section;

an accommodation chamber for containing a hydraulic medium is arranged between the fix section and the movable adjustment section;

at least two hydraulic supports 100 and the liquid storage device are communicated with each other by the communicating device; the hydraulic medium flows between the hydraulic supports 100 along with the pressure changing, and the hydraulic medium drives the movable adjustment section to move axially for leveling under pressure; the hydraulic medium is injected into/sucked from the hydraulic supports through the liquid storage device to control the lifting and lowering of the hydraulic supports.

The hydraulic lifting support of the present embodiment has two functions:

1. The hydraulic lifting support of the present embodiment, based on the hydraulic principle, the movable adjustment section can automatically perform adaptive regulation because of the fluidity of the hydraulic medium due to different pressures resulting from unflatness. The hydraulic medium stops circulating until the leveling device achieves balance, and thus, automatic leveling is achieved.

2. The hydraulic lifting support of the present embodiment further comprises a liquid storage device for storing more hydraulic medium, so that after the hydraulic medium reaches the pressure equilibrium state, the hydraulic medium in the liquid storage device can be injected into the hydraulic support to increase the lifting range of the hydraulic support to meet more usage scenarios and requirements of the user.

Further, the communicating device of the present embodiment comprises a hydraulic pipe 200 and a communicating member 300. One end of the hydraulic pipe 200 connects with the hydraulic supports 100 or the liquid storage device, and the other end connects with a same communicating member 300. The liquid flow channels communicated with each other are arranged inside the communicating member 300 for communicating between the hydraulic supports, and between the hydraulic supports and the liquid storage device.

Preferably, the communicating member 300 is a three-way communicating member, and the three connection ends of the three-way communicating member are respectively connected with two hydraulic supports 100 and the liquid storage device through the hydraulic pipe 200.

As a preferred implementation mode of the present embodiment, the liquid storage device of the present embodiment comprises a liquid storage tank 400 containing the hydraulic medium and a driving device 500 for driving the hydraulic medium in the liquid storage tank 400 to flow into the hydraulic support.

Preferably, the diameter of the liquid storage tank 400 is larger than the diameter of the hydraulic support 100, and the miniaturization of the motor can be realized. That is, a motor with a small output power can also meet the demand, and the cost is reduced.

Concretely, the driving device 500 comprises a motor and a piston mechanism. The piston mechanism is disposed in the liquid storage tank 400, and the output end of the motor is connected with the piston mechanism to drive the piston mechanism to slide inside the liquid storage tank 400. The motor is energized to drive the piston mechanism to compress the hydraulic medium in the liquid storage tank, and the hydraulic medium in the liquid storage tank 400 is injected into the hydraulic supports 100.

As a preferred implementation mode of the present embodiment, the fix section comprises a hydraulic plate 101 and a sheath 103 connected with the hydraulic plate 101. A hollow chamber is arranged in the sheath 103 and extends axially through the sheath. The movable adjustment section is a regulating element 104, and an inner chamber with one opening end is arranged inside the regulating element 104. One end of the sheath 103 is sleeved inside the regulating element 104 and is capable of moving axially relative to the regulating element 104. The hollow chamber and the inner chamber form the accommodation chamber together.

The hydraulic plate 101 internally has a hydraulic plate flow channel for allowing the hydraulic medium to flow, and the hydraulic plate flow channels of the hydraulic supports 100 are connected by the communicating device for allowing the hydraulic medium to flow between the hydraulic supports 100.

As a preferred implementation mode of the present embodiment, a limiting slide/limiting chute is arranged on an outer peripheral wall of the sheath 103, and a limiting chute/limiting slide is arranged on the inner wall of the inner chamber of the regulating element 104. The limiting slide axially slides along the limiting chute to limit the relative rotation between the regulating element and the sheath. The present embodiment prevents relative rotation between the sheath 103 and the regulating element 104. As a result, only axial relative movement between the two members is allowed and the leveling process is more stable and effective.

Further, a limiting block is arranged at the end of the limiting chute to prevent the sliding out of the limiting slide.

The hydraulic support 100 of the present embodiment adopts hydraulic principle to achieve leveling. Therefore, the airtightness of the hydraulic medium has a great influence on the leveling effectiveness of the hydraulic support 100. As a hermetical method of the hydraulic medium in the present embodiment, the fixe section and the movable adjustment section are hermetically dynamic connected. In this way, a sealed accommodation chamber can be formed between the fix section and the movable adjustment section to achieve the sealing of the hydraulic medium. Specifically, the hydraulic plate 101 of the present embodiment is connected with the sheath 103 in a static seal manner, and the sheath 103 is connected with the regulating element 104 in a dynamic seal manner.

As another hermetical method of the hydraulic medium in the present embodiment, the hydraulic support 100 further comprises a flexible accommodation body arranged in accommodation chamber. The flexible accommodation body has a cavity, and the hydraulic medium is accommodated in the cavity. Moreover, the flexible accommodating body deforms along with the flow of the hydraulic medium and drives the movable adjustment section to leveling in the outer axis of the fix section.

Concretely, the flexible accommodation body comprises an opening. The opening of the flexible accommodating body is hermetically mounted on the hydraulic plate 101, and the opening communicates with the hydraulic plate flow channel. In this embodiment, it is only need to hermetically communicate the flexible accommodation body with the hydraulic plate 101 by accommodation the hydraulic medium inside the flexible accommodating body, thereby simplifying the installation between the hydraulic plate 101, the sheath 103, and the regulating element 104.

The hydraulic plate 101 in this embodiment has a hydraulic nozzle. The hydraulic nozzle communicates with the hydraulic plate flow channel in the hydraulic plate. The communicating member 300 has a communicating nozzle and communicates with a liquid flow channel in the communicating member. The two ends of the hydraulic pipe 200 of the present embodiment are connected to the hydraulic nozzle and the communicating nozzle, respectively.

In the present embodiment, the communicating member 300 is provided with a filler opening, and the filler opening communicates with the liquid flow channel of the communicating member 300. Thus, after the hydraulic support is filled with the hydraulic medium that poured through the filler opening, the filler opening is hermetically installed by the sealing member. The filling method of the hydraulic medium in this embodiment is simple and convenient, which greatly simplifies the filling method of the hydraulic medium.

According to the present embodiment, the flexible accommodation body comprises an accommodating body. The accommodating body is a soft capsular structure with a retractable corrugation structure. And the corrugation structure is arranged in the regulating element 104 and extends and retracts depending on the flowing of the hydraulic medium to drive the regulating element 104 to axially move in the sheath 103 for leveling.

The hydraulic support of the present embodiment further comprises protective ring for protecting the flexible accommodation body. A pressing ring is embedded in the protective ring, and then, the technical effects as follows are achieved:

1. According to the present embodiment, the embedded installation between the pressing ring and the protection ring can play a limiting role to avoid the installation of a complicated limiting structure, and the limiting structure is simple and stable.

2. According to the hydraulic support provided by the present embodiment, under extremely high impact pressure (for example, a household appliance or an object equipped with the hydraulic support falls off or is lifted and suddenly placed), as there is no gap between the protective ring and the pressure exerted fitting surfaces of the flexible accommodation body, so that the flexible accommodation body is prevented from problems such as expansion cracking resulting from gaps, and the reliability is improved.

3. According to the present embodiment, the pressing ring and the protective ring are mounted in an embedded manner, and the mounting height of the pressing ring and the protective ring is lowered, so that the overall height of the hydraulic support is lowered. And the influence on the overall center of gravity of the household appliance caused by mounting the support for household appliance on the household appliance is less, the stability of supporting of the household appliance is better facilitated, and the shock absorption effect on vibration of the household appliance during working (for example, dewatering vibration of the washing machine) is better.

As a preferred implementation mode of the present embodiment, a protective curved surface is arranged at one end of the protective ring and is matched with an outside surface of the flexible accommodation body to prevent the flexible accommodation body from being broken under pressure.

According to the present embodiment, an embedding groove is formed in the other end of the protective ring, and the pressing ring is embedded in the embedding groove of the protective ring.

As a preferred implementation mode of the present embodiment, a limiting convex portion is formed on the internal wall of the embedding groove of the protective ring, and a limiting concave portion matched with the limiting convex portion is formed on a fixing member. According to the embodiment, a limiting structure is designed according to the embedded mounting of the pressing ring and the protective ring, and limiting motion is achieved while carrying out embedded mounting. And thus, the structure is simple, stable and reliable.

In the embodiment, the circumference of the protective ring completely wraps the pressing ring, and the protective ring is pressed into the regulating element 104, and thus, the reliability and the stability of fitting are greatly improved. Therefore, after the protective ring of the present embodiment is pressed into the regulating element 104, the protective ring will always axially move in the regulating element 104 stably, and the moving is smooth and reliable. The entire hydraulic support can be more stable because of the protective ring and the regulating element 104, and both the protective ring and the pressing ring can have a certain amount of activity up and down.

As the household appliance (for example, a washing machine) generally will generate vibration during working, in order to guarantee the stability of the running of the household appliance, the overall height of the support for household appliance provided by the embodiment should be lowered as far as possible to lower the center of gravity of the household appliance. Therefore, the ports are formed in the hydraulic plate 101 corresponding to the limiting slides. While meeting the setting of the guide limiting mechanism, it does not affect the axial movement of the regulating element 104, so as to reduce the overall height of the support for household appliance and improve the damping stability.

Embodiment 2

As shown in FIG. 1 to FIG. 4, a washing machine with the hydraulic lifting supports described in embodiment 1 is provided. And the washing machine is a drum washing machine. The drum washing machine comprises a shell and a door 800 mounted on the shell and capable of being opened/closed. The shell comprises a front plate 902 and a bottom plate 901. The front plate 902 is provided with a door opening, and the door 800 is mounted on the front plate 902 to close/open the door opening. The hydraulic lifting support is installed on the bottom plate 901 and is disposed in an edge where the bottom plate intersects with the front plate 902.

Further, the washing machine of the present embodiment comprises a control device 1000, the motor 500 of the liquid storage device is electrically connected with the control device 1000, and the control device 1000 controls the operation of the motor 500 to enable the hydraulic medium to flow into the hydraulic support 100.

The motor 500 of the present embodiment connects with the control device by the power line 600 and the signal line 700.

As a preferred implementation mode of the present embodiment, two hydraulic supports 100 are respectively installed on two corners of the bottom plate 901, and the two corners are next to the front plate 902. The two hydraulic supports 100 and the liquid storage device are communicated with each other by the communicating device. In addition, two bolt supports 1300 are respectively installed on the other two corners of the bottom plate 901.

The shell of the present embodiment further comprises a side plate 903 and a top plate 904.

An outer tub 1100 and inner tub are coaxially mounted inside the shell. The outer tub 1100 is used for containing the washing water, and the inner tub can be driven and rotated by the washing machine motor to achieve the beat and dewatering of the laundry.

A detergent box 900 is mounted on the front plate 902 of the washing machine so that it is convenient for the consumer to put in the laundry treatment agent; and a control panel is installed on the front plate to facilitate the operation of the washing machine by the consumer.

A principle and a method for achieving automatic leveling of the washing machine by the leveling device of the present embodiment, after the washing machine is mounted, different hydraulic supports are different in horizontal height due to an out-of-flat ground surface. The supports located at pits of the ground surface are lower in position. Thus, the hydraulic supports at higher positions firstly bear the weight of the washing machine and bear a large gravity force, and the hydraulic supports at lower positions bear a smaller gravity force or have a failure support problem.

The regulating elements of the hydraulic supports at high positions move up under high pressure, and heights of the entire supports are reduced, thus, volumes of hollow chambers of flexible accommodation bodies full of the hydraulic medium are compressed and reduced. The hydraulic medium is forced to enter throttling holes or valve holes and then enter into the supports at low positions through high pressure pipes. Thus, the hydraulic medium in the flexible accommodation bodies of the hydraulic supports at low positions becomes more and more, and the flexible accommodation bodies are expanded to promote the stretching of the regulating elements.

When the supports at higher positions and the supports at lower positions are the same in hydraulic pressure, the hydraulic medium does not flow through the high pressure pipes any more. Relative positions of the regulating elements and the bottom plate of the washing machine do not change any more, and the automatic regulating of the washing machine is completed.

During the washing or dewatering process of the washing machine, the hydraulic medium can also slowly flow for self-leveling, so that vibration noises of the washing machine are greatly lowered.

According to the present embodiment, the hydraulic medium may be hydraulic fluid, which is good in fluidity and stable in ingredient.

In addition, the leveling device of the present embodiment can also be applied to household appliance such as electric refrigerators, coolers and air-conditioner indoor units, besides washing machine.

Embodiment 3

The present embodiment provides a controlling method for the washing machine according to embodiment 2. If the washing machine detects that users need to open the door for adding clothes in the halfway and the water level is higher than the door opening, then the liquid storage device is controlled to inject the hydraulic medium into the hydraulic support. Thus the support height of the hydraulic support is raised, so that the side with the door of the washing machine is rised along with the lifting of the hydraulic support. If the water level is detected lower than the door opening, the door is allowed to open.

Further, if the washing machine detects that users finish adding clothes, the door is closed and the motor of the liquid storage device is controlled to be power off. Next, the hydraulic medium in the hydraulic support is gradually returned to the liquid storage tank under the gravity of the washing machine. Thus, the hydraulic support implements the automatic leveling during the flowing of the hydraulic medium.

The controlling method of the washing machine of the present embodiment enables the control device of the washing machine to send a signal to the motor and provide power when the consumer needs to add the left laundry that needs to be washed halfway. After pressing a pause button or a specific halfway button, the motor starts and compresses the hydraulic medium in the liquid storage tank to flow into the hydraulic support. Thus, the continuous extension of the regulating element and the extension of the front hydraulic support are achieved. Next, the front of the washing machine is raised, and then washing water level is lower than the seal of the door and window. Even if a consumer opens the door, the washing water will not overflow.

It should be noted that each of the above-mentioned embodiments of the present disclosure can be installed independently and can also be installed by combining a plurality of embodiments.

What described above are only preferred embodiments of the present disclosure, but are not intended to limiting the scope of the present disclosure in any forms. Although the present disclosure has been disclosed in terms of preferred embodiments, it is not limited thereto. Without departing from the scope of the technical solution of the present disclosure, any person skilled in the present disclosure can make equivalent embodiments with various alterations and modifications as equivalent variations by utilizing the above-mentioned technical contents. However, without departing from the contents of the technical solution of the present disclosure, any simple changes, equivalent variations and modifications made according to the technical essence of the present disclosure shall all be covered within the scope of the technical solution of the present disclosure.

The invention claimed is:

1. A hydraulic lifting support for supporting and leveling a household appliance, comprising a hydraulic support, a communicating device and a liquid storage device, wherein: the hydraulic support comprises:

a fix section, installed at a bottom of the household appliance;

a movable adjustment section, sleeved on/in the fix section and axially movable relative to the fix section;

an accommodation chamber for containing a hydraulic medium is arranged between the fix section and the movable adjustment section;

at least two hydraulic supports and a liquid storage device are communicated with each other by a communicating device; the hydraulic medium flows between the hydraulic supports along with the pressure changing, and the hydraulic medium drives the movable adjustment section to move axially for leveling under pressure; the hydraulic medium is injected into/sucked from the hydraulic supports through the liquid storage device to control the lifting and lowering of the hydraulic supports.

2. The hydraulic lifting support according to claim 1, wherein the communicating device comprises a hydraulic pipe and a communicating member; one end of the hydraulic pipe connects with the hydraulic support or the liquid storage device, another end connects with a same communicating member; a liquid flow channel communicated with each other is arranged in the communicating member for communicating between the hydraulic supports, and between the hydraulic support and the liquid storage device.

3. The hydraulic lifting support according to claim 1, wherein the liquid storage device comprises a liquid storage tank containing the hydraulic medium and a driving device for driving the hydraulic medium in the liquid storage tank to flow into the hydraulic support.

4. The hydraulic lifting support according to claim 3, wherein the driving device comprises a motor and a piston mechanism;

the piston mechanism is disposed in the liquid storage tank, and an output end of the motor is connected with the piston mechanism to drive the piston mechanism to slide inside the liquid storage tank;

the motor is energized to drive the piston mechanism to compress the hydraulic medium in the liquid storage tank, and the hydraulic medium in the liquid storage tank is injected into the hydraulic support.

5. The hydraulic lifting support according to claim 1, wherein the fix section comprises a hydraulic plate and a sheath fixedly connected with the hydraulic plate;

a hollow chamber is arranged in the sheath and extends axially through the sheath; the movable adjustment section is a regulating element, and an inner chamber with one opening end is arranged inside the regulating element; one end of the sheath is sleeved inside the regulating element and is capable of moving axially relative to the regulating element; the hollow chamber and the inner chamber form the accommodation chamber together;

the hydraulic plate is internally provided with a hydraulic plate flow channel for allowing the hydraulic medium to flow, and the hydraulic plate flow channels of the hydraulic supports are connected by the communicating device for allowing the hydraulic medium to flow between the hydraulic supports.

6. A washing machine with the hydraulic lifting support according to claim 1, the washing machine being a drum washing machine, comprising a shell and a door mounted on the shell and capable of being opened/closed;

the shell comprises a front plate and a bottom plate; the front plate is provided with a door opening, and the door is mounted on the front plate to close/open the door opening; the hydraulic lifting support is installed on the bottom plate and is disposed in an edge where the bottom plate intersects with the front plate.

7. The washing machine according to claim 6, further comprising a control device, wherein the motor of the liquid storage device is electrically connected with the control device, and the control device controls the operation of the motor to enable the hydraulic medium to flow into the hydraulic support.

8. The washing machine according to claim 6, wherein two hydraulic supports are respectively installed on two corners of the bottom plate near the front plate; the two hydraulic supports and the liquid storage device are communicated with each other by the communicating device; two bolt supports are respectively installed on the other two corners of the bottom plate.

9. A controlling method of the washing machine according to claim 6, comprising:

if the washing machine detects that users need to open the door for adding clothes in the halfway and a water level is higher than the door opening, controlling the liquid storage device to inject the hydraulic medium into the hydraulic support to raise a support height of the hydraulic support, so that a side with the door of the washing machine rises along with the lifting of the hydraulic support;

if the water level is detected lower than the door opening, then the door is allowed to open.

10. The controlling method according to claim 9, wherein, if the washing machine detects that users finish adding clothes, the door is closed and the motor of the liquid storage device is controlled to be power off;

the hydraulic medium in the hydraulic support is gradually returned to the liquid storage tank under the gravity of the washing machine; and the hydraulic support implements automatic leveling during the flowing of the hydraulic medium.

11. The hydraulic lifting support according to claim 2, wherein the communicating member is a three-way communicating member, and three connection ends of the three-way communicating member are respectively connected with two hydraulic supports and the liquid storage device through the hydraulic pipe.

12. The hydraulic lifting support according to claim 2, wherein the liquid storage device comprises a liquid storage tank containing the hydraulic medium and a driving device for driving the hydraulic medium in the liquid storage tank to flow into the hydraulic support.

13. The hydraulic lifting support according to claim 2, wherein the fix section comprises a hydraulic plate and a sheath fixedly connected with the hydraulic plate;

a hollow chamber is arranged in the sheath and extends axially through the sheath; the movable adjustment section is a regulating element, and an inner chamber with one opening end is arranged inside the regulating element; one end of the sheath is sleeved inside the regulating element and is capable of moving axially relative to the regulating element; the hollow chamber and the inner chamber form the accommodation chamber together;

the hydraulic plate is internally provided with a hydraulic plate flow channel for allowing the hydraulic medium to flow, and the hydraulic plate flow channels of the hydraulic supports are connected by the communicating device for allowing the hydraulic medium to flow between the hydraulic supports.

14. The hydraulic lifting support according to claim 3, wherein the fix section comprises a hydraulic plate and a sheath fixedly connected with the hydraulic plate;

a hollow chamber is arranged in the sheath and extends axially through the sheath; the movable adjustment section is a regulating element, and an inner chamber with one opening end is arranged inside the regulating element; one end of the sheath is sleeved inside the regulating element and is capable of moving axially relative to the regulating element; the hollow chamber and the inner chamber form the accommodation chamber together;

the hydraulic plate is internally provided with a hydraulic plate flow channel for allowing the hydraulic medium to flow, and the hydraulic plate flow channels of the hydraulic supports are connected by the communicating device for allowing the hydraulic medium to flow between the hydraulic supports.

15. The hydraulic lifting support according to claim 4, wherein the fix section comprises a hydraulic plate and a sheath fixedly connected with the hydraulic plate;

a hollow chamber is arranged in the sheath and extends axially through the sheath; the movable adjustment section is a regulating element, and an inner chamber with one opening end is arranged inside the regulating element; one end of the sheath is sleeved inside the regulating element and is capable of moving axially relative to the regulating element; the hollow chamber and the inner chamber form the accommodation chamber together;

the hydraulic plate is internally provided with a hydraulic plate flow channel for allowing the hydraulic medium to flow, and the hydraulic plate flow channels of the hydraulic supports are connected by the communicating device for allowing the hydraulic medium to flow between the hydraulic supports.

16. The washing machine according to claim 7, wherein two hydraulic supports are respectively installed on two corners of the bottom plate near the front plate; the two hydraulic supports and the liquid storage device are communicated with each other by the communicating device; two bolt supports are respectively installed on the other two corners of the bottom plate.

* * * * *